United States Patent [19]

Artin et al.

[11] 4,273,013

[45] Jun. 16, 1981

[54] SLICING MACHINE

[75] Inventors: Robert L. Artin, Menomonee Falls; Allen C. Eimerman, Milwaukee, both of Wis.

[73] Assignee: Sunbeam Corporation, Chicago, Ill.

[21] Appl. No.: 55,861

[22] Filed: Jul. 9, 1979

[51] Int. Cl.[3] ..... B26D 4/28

[52] U.S. Cl. ..... 83/167; 83/707; 83/478; 83/571; 83/729

[58] Field of Search ..... 83/707, 729, 167, 730, 83/571, 478

[56] References Cited

U.S. PATENT DOCUMENTS

| | | | |
|---|---|---|---|
| 3,938,602 | 2/1978 | Sly et al. | 83/707 |
| 4,070,941 | 1/1978 | Lorenz | 83/478 |
| 4,116,099 | 9/1978 | Mayer | 83/571 |

FOREIGN PATENT DOCUMENTS

| | | | |
|---|---|---|---|
| 459165 | 3/1972 | Australia . | |
| 320900 | 3/1975 | Austria . | |
| 1104660 | 4/1961 | Fed. Rep. of Germany | 83/707 |
| 1278872 | 9/1968 | Fed. Rep. of Germany | 83/707 |
| 6906246 | 2/1969 | Fed. Rep. of Germany . | |
| 7032066 | 8/1970 | Fed. Rep. of Germany . | |
| 2343287 | 8/1973 | Fed. Rep. of Germany | 83/707 |
| 2338523 | 10/1977 | Fed. Rep. of Germany . | |
| 1469558 | 4/1977 | United Kingdom . | |
| 1488144 | 10/1977 | United Kingdom . | |
| 1536106 | 12/1978 | United Kingdom . | |

*Primary Examiner*—Donald R. Schran

*Attorney, Agent, or Firm*—George R. Clark; Neil M. Rose; Robert J. Fox

[57] ABSTRACT

A slicing machine having a housing containing an electric motor in driving connection with a circular blade for slicing meat, cheese and the like, the housing having an adjustable stop plate mounted thereon in proximity with a portion of the circular blade to permit a user to select a desired slice thickness and which also provides a blade guard when the slicing machine is stored. A wedge-shaped table member which slidably fits over the blade in engagement with the housing to provide a cover for storage and can be slidably fitted to said housing to provide a table extending from a front portion of said housing. A curved dish access member, having an integral arcuate ledge, formed integral with a rear portion of the housing provides means whereby a dish may be placed in proximity with the housing during operation, not only to receive sliced foodstuffs but also the juices therefrom.

10 Claims, 13 Drawing Figures

SLICING MACHINE

BACKGROUND OF THE INVENTION

Slicing machines of the general type disclosed herein comprise one variety of several different types of slicing machines employed by many persons for slicing foodstuffs. It is apparent that in the past many persons have desired to purchase slicing machines for domestic use which would provide sliced meat, cheese, and the like of a quality comparable to that provided by commercial slicing machines used in restaurants and food stores. A number of slicing machines have been available for sometime, as exemplified by the "commercial grade" machines disclosed in Australian Patent Specification No. 459,165 to Pratley. An inspection of the disclosure reveals that a machine embodying the Pratley invention is composed to a great extent of metal and is built to quite exacting specifications. In order to meet the demands of heavy use in a commercial environment, the Pratley device, while being a very fine food slicer, suffers from the drawback that it is somewhat impractical for domestic use since the price is prohibitive for most persons.

Although the average consumer would be unable or unwilling to spend the money for a domestic slicing machine of the Pratley variety, a somewhat less expensive machine is attractive to the consumer.

The general type of domestic food slicer commonly having a plastic housing and a serrated blade, which rotates at relatively low speed, is disclosed in U.S. Pat. Nos. 4,070,941 and 4,116,099, respectively to Lorenz and Mayer. Another machine of this type is disclosed in Gebrauchmuster No. 69 06 246, which discloses a meat slicer of the type similar to one which is now being sold in the United States; also related is Gebrauchmuster No. 70 32 066. Perhaps one of the best disclosures of the domestic slicing machine can be found in British Patent Specification No. 1,469,558 to BoschSiemens Hausgerate GmbH. This British patent specification in particular shows details of a large diameter screw associated with the stop plate adjusting mechanism which controls the thickness of the slices made by the machine. The large diameter screw provides support and lateral alignment to a stop plate, as well as serving to advance and retract the plate to achieve the desired slice thickness. British Patent Specification No. 1,488,144 discloses and claims details of a drive mechanism for a domestic slicing machine of the abovementioned type wherein an electric motor is connected though a speed reducing gear train to a circular serrated blade.

Although the domestic slicing machines taught in the above-mentioned patents provide good performance for domestic food slicing, they suffer from several drawbacks. For example, U.S. Pat. No. 4,070,941 discloses a slicing machine wherein a plate 46, which acts as a food holding table, is connected through a hinge shown as a rotatable sleeve 63, which is folded down for operation and folded up for storage. Despite the compact storage arrangement in its operating position, the housing is positioned perpendicular with respect to the work surface on which it rests. It is apparent that any liquids, such as juice from meats being sliced in such a device, have a tendency to pool immediately adjacent the blade necessitating periodical tipping of the machine to drain the juices and causing the machine to become soiled rather quickly. Since the slicing machine is used for slicing foodstuffs, it is apparent that cleanliness is a necessity to prevent the build-up of food residue, which might spoil and taint foods being sliced in the slicer.

The prior art domestic slicing machines, because of their vertical attitude, require that all force urging the food into contact with the slicing blade be provided by the operator who exerts pressure on a slider block movable in a horizontal plane toward and away from the slicing blade. One of the prior art devices disclosed in U.S. Pat. No. 4,116,099 to Mayer, teaches the use of a fixed table or in the alternative, one which can be detached and folded up in the rest position. It may be appreciated that while positive engagement between the housing and table may be achieved through the pins extending from the table into the housing, this is a somewhat awkward method of assembly. Thus, although the concept of an economical domestic slicing machine is well-known in general, the prior art devices suffer from the drawbacks detailed above.

SUMMARY OF THE INVENTION

Briefly, the present invention is concerned with an electric food slicing machine for use in the home, which is economical to manufacture and effective in its operation. The slicing machine is in the same general class of lightweight electric slicers which are discussed above. The slicing machine includes a housing having an alternating current electric motor of conventional design mounted therein. The motor is connected through a speed reducing gear train to a circular serrated removable blade. A laterally adjusted stop plate having a slice thickness selecting knob is mounted adjacent the circular blade. Rotation of the adjusting knob can selectively position the stop plate at any point in a range of positions having as limits a storage position wherein the stop plate is positioned substantially coplanar with the circular blade to a position wherein the adjusting knob, if rotated slightly further, disengages from the stop plate. Immediately behind the blade and nearer the bottom portion thereof, a curved, dish access member is formed integral with other portions of the housing and defines a substantially vertical wall member having an arcuate wall which defines a portion of the cylinder terminating in an arcuate ledge position substantially perpendicular to a cylindrical wall section and which is adapted to receive a dish positioned so that the arcuate ledge overlaps the dish whereby slices of meat and the like, together with juices yielded during the slicing process are directed into the dish. A combination table and partial cover member is provided, which has a taper, the table slidably connecting to the housing and being positioned at a right angle to the blade when assembled with the housing in an operative configuration. Compact storage of the table is achieved by having the table adapted to be slidably fitted to the housing substantially parallel therewith so that the table covers the greater portion of the blade in such a manner that the table and housing assume only a slightly larger volume than the housing alone.

Accordingly, it is an object of the present invention to provide a slicing machine having means whereby the food being sliced, in particular meat, which releases liquids during slicing, directs the liquids or juices onto a receptacle, together with the meat.

It is another object of the present invention to provide a slicing machine whereby the machine is tilted slightly rearward to provide good drainage in the rear of the blade and has a tendency to allow the food to be sliced to move into engagement with the blade under the influence of gravity.

It is a further object of the instant invention to provide a slicing machine wherein a table can be removably slidably fitted to the housing for operation therewith and includes a portion of the housing and blades for storage in slidable engagement therewith.

Further objects and advantages of the present invention will become apparent as the following description proceeds and the features of novelty which characterize the invention will be pointed out with particularity in the claims annexed to and forming a part of this specification.

DESCRIPTION OF THE PREFERRED EMBODIMENT

Figure 1:
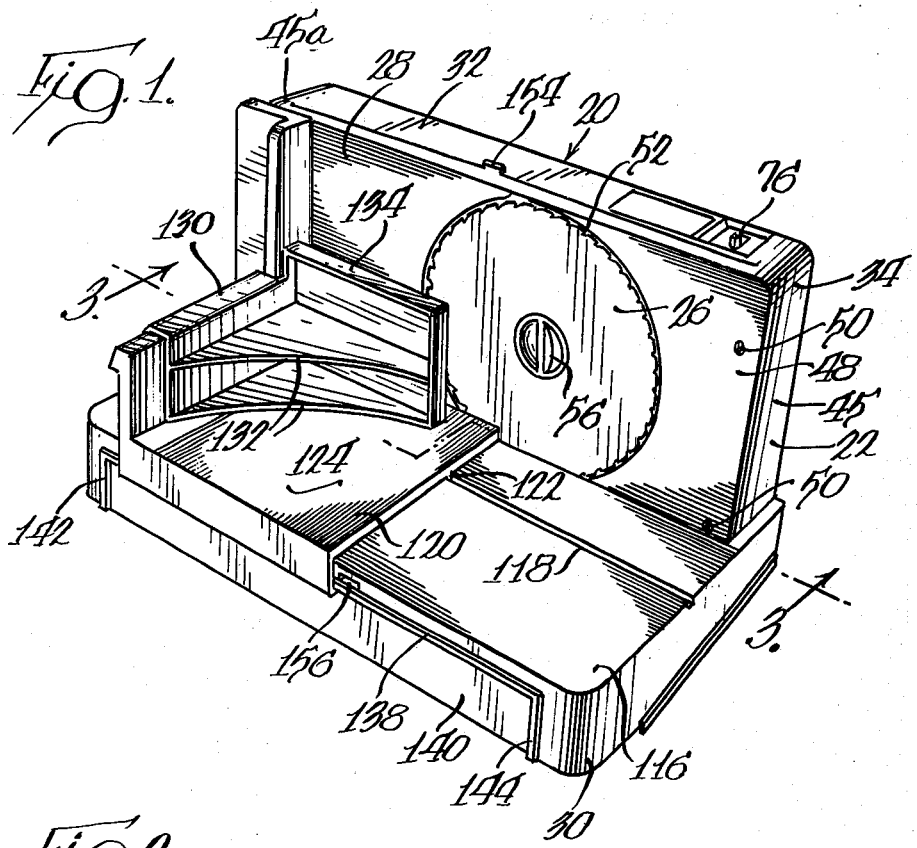
FIG. 1 is a perspective view of the slicing machine of the present invention in operating configuration.

Referring now to the drawings, the present invention is illustrated as embodied in a slicing machine generally designated by the reference numeral 20. Essentially, the slicing machine comprises a housing 22 wherein is mounted an electric motor 24, which is drivingly connected to a flat, circular serrated blade 26. A stop plate 28 is movably mounted on housing 22 and can be positioned at a preselected position with respect to the circular blade to define the thickness of a slice taken from a foodstuff being sliced. A table or cover 30 having a generally wedge-shaped configuration acts as a table which is locked into a right angle relationship with the housing 22 during food slicing operations and is positioned parallel to and substantially encloses a portion of the housing 22 and circular blade 26 in a storage configuration, as may best be seen in FIG. 2.

Figure 4:
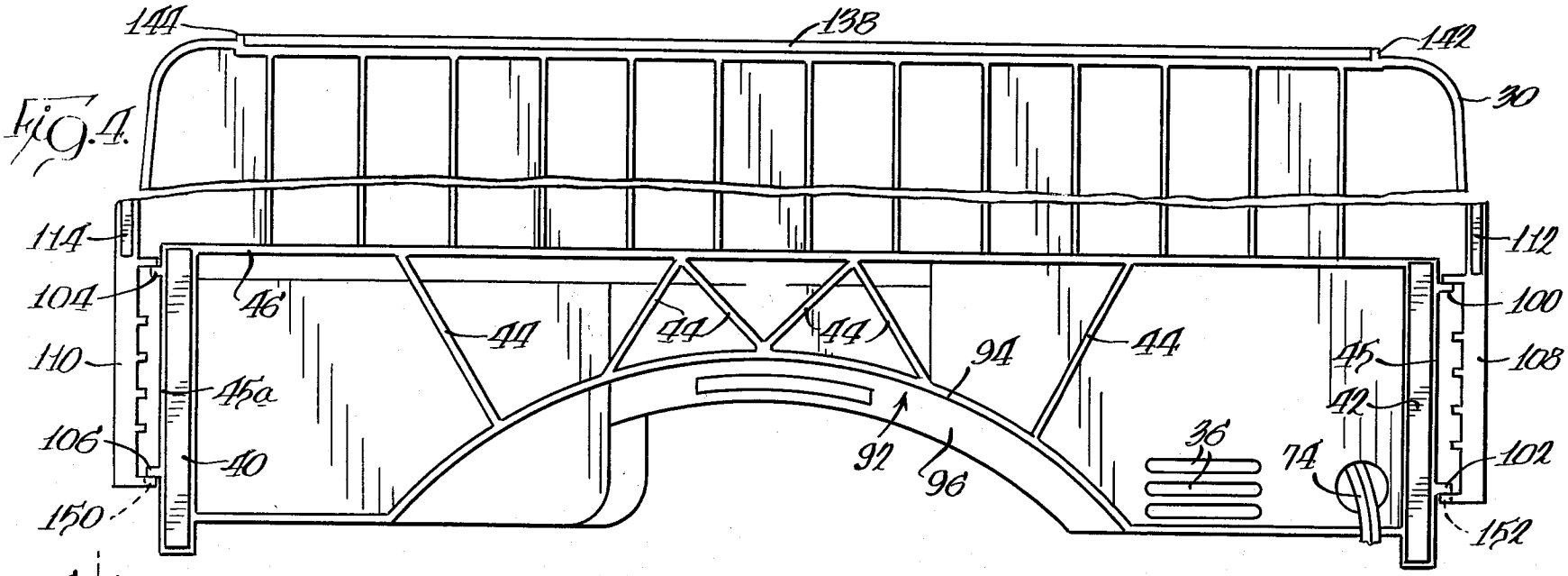
FIG. 4 is a bottom view of the present invention in operating configuration wherein a section of the table has been eliminated for clarity.

In order to provide for the two primary functions of the housing 22, housing 22 includes a stop plate section 32 which supports and positions a stop plate with respect to the other portions of the housing 22 and a blade and drive assembly section 34 which contains electric motor 24 and rotatably supports circular serrated blade 26. Blade and drive assembly section 34 has a vent 36 (as shown in FIG. 4) positioned in the bottom thereof to provide for the flow of cooling air to portions of the electric motor and the associated drive assembly elements which become heated during operation. The housing 22 is generally rectangular in shape and is thin compared to the height and length thereof.

Support for housing 22 is provided for (as may best be seen in FIG. 4) by a pair of elongated rubber feet 40 and 42, mounted in the bottom thereof. Structural integrity for the housing is provided by the use of a plurality of web members 44 which are formed integral with the other portions of the housing and extend downwardly therefrom in a substantially vertical attitude. Web members 44 terminate at a front housing wall 46 which is substantially planar and are positioned beneath stop plate 28 and serrated blade 26.

A removable motor supporting wall 48 forms a portion of housing 22 and is assembled thereto by a plurality of threaded members 50, as shown in FIG. 1. A portion of the removable motor supporting wall is recessed to receive circular blade 26 so that blade 26 is flush or coplanar with a flat portion 54 of the wall 48. This recessing of the blade 26 provides a guard for the inoperative portions of blade 26 and minimizes or prevents injury from accidental contact with the moving blade.

The circular serrated blade 26 is sharpened on its outer edge in order to slice foodstuffs placed on table 30 of the meat slicer and moved transversely against the edge of the blade. Blade 26 has a center, two-tab bayonet connecting knob 56 which is removably connected to a mating bayonet fixture 58 which comprises a portion of the removable motor supporting wall 48. During operation of the slicer, bayonet connecting knob 56 does not rotate with blade 26 but, rather, remains locked to motor supporting wall 48 and serves as a bearing for the rotating blade.

In order to rotate the blade 26, an annular spur 60 of relatively large diameter is riveted to the rear portion of blade 26 and receives bayonet connecting knob 56 through a central aperture 62. A driving connection between spur gear 60 and electric motor 24 is effected through a gear train comprising a spur gear 64 which is in turn driven from a worm gear 68. Worm gear 68 is formed on the armature shaft of a conventional alternating current electric motor of a well-known type such as is often used in blenders. In order to cool motor 24 and the associated drive train comprising gears 60, 64, 66 and 68, a conventional axial flow fan 70 is mounted on a power take-off shaft 72 to which worm gear 68 is also connected.

Electrical power is supplied to motor 24 from a conventional power outlet by a power cord 74 which is electrically connected to motor 24 in series through a spring loaded switch 76. It is necessary to employ normally open switch 76 in order that motive power be cut off from blade 26 as soon as the operator's hand moves out of contact with the upper portion of housing 22 wherein switch 76 is mounted so as to lessen the possibility of accidents occurring.

Figure 8:
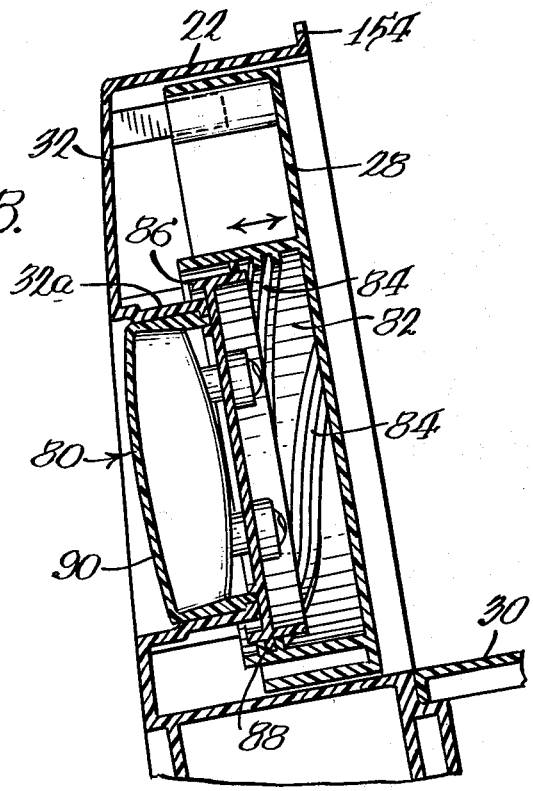
FIG. 8 is an enlarged sectional view showing further details of the stop plate and associated carriage assembly shown in FIG. 7.
Figure 9:
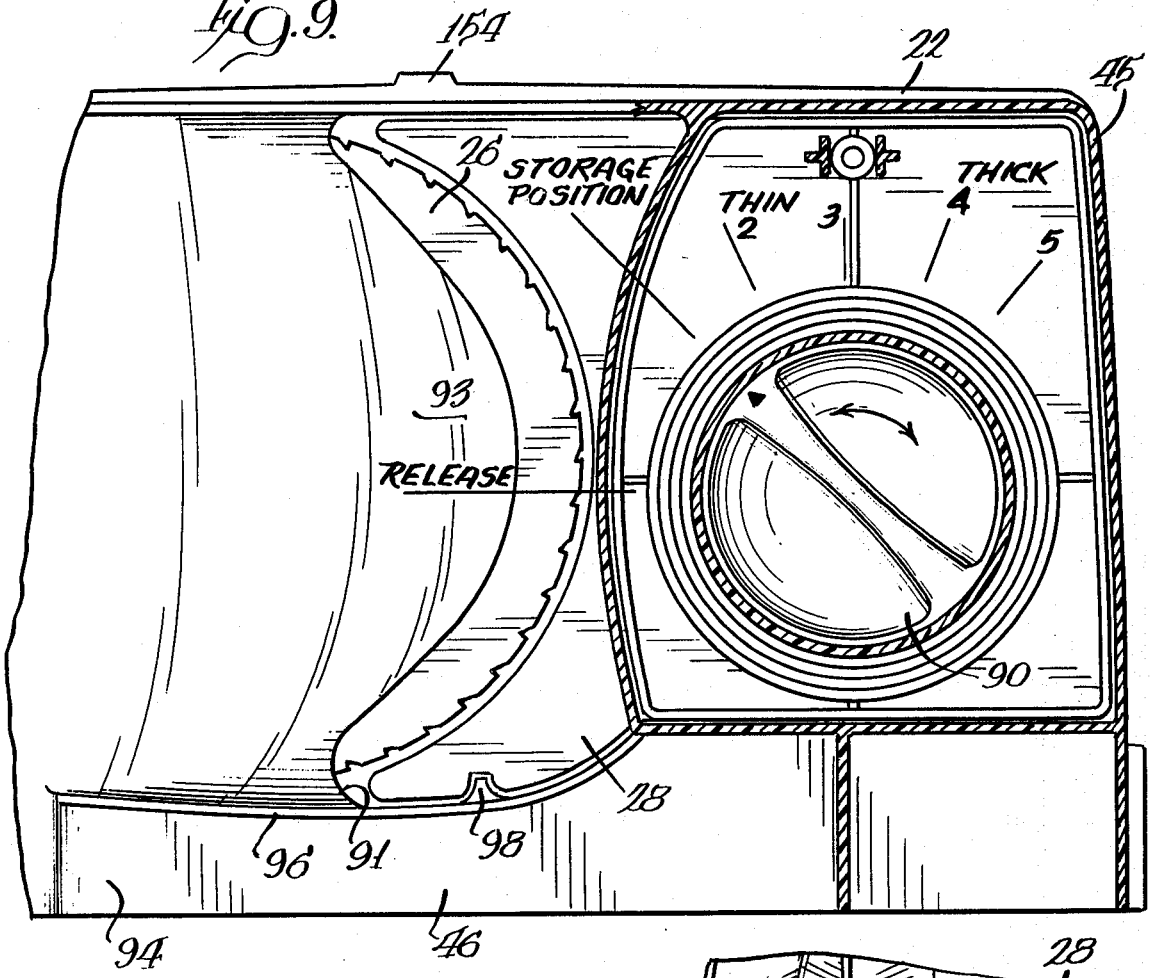
FIG. 9 is a sectional view taken along line 9—9 of FIG. 7.
Figure 10:
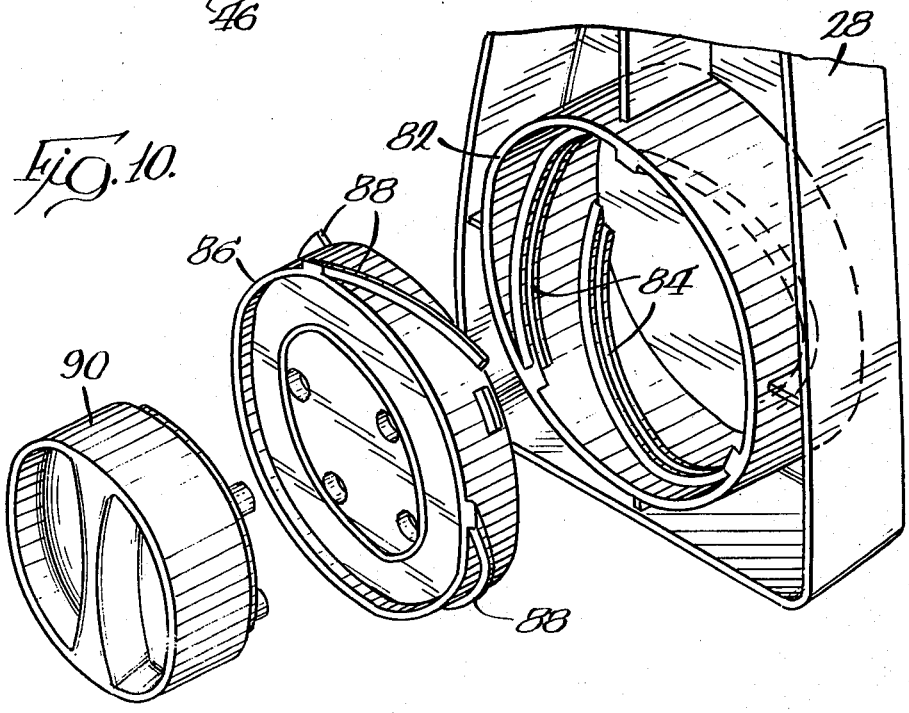
FIG. 10 is an exploded perspective view of portions of the stop plate carriage assembly.

It is desirable to be able to select a thickness of a slice of meat, cheese or the like which is sliced by blade 26. Accordingly, a carriage means 80 connects stop plate 28 to stop plate 28 of housing 22. Stop plate 28 includes a cylindrical sleeve 82 formed integral therewith and extending laterally therethrough. Sleeve 82 has a plurality of partially arcuate threads 84 positioned therein which receives a sleeve engaging member 86, best shown in FIGS. 7, 8 and 10. Sleeve engaging member 86 has a plurality of complementary members 88 which engage threaded members 84. A selector knob 90 is connected to sleeve engaging member 86. The sleeve engaging member 86 and the knob 90 comprise the carriage means 80 which connects and interrelates the housing 22 with the stop plate 28. The carriage means 80 is in a sleeve 32*a* formed integrally with section 32 of housing 22. Selector knob 90 may be rotated through an arc which causes stop plate 28 to extend from a position substantially coplanar with blade 28 which is the storage position as shown in FIG. 9 through an arc of more than 90° to a position wherein stop plate 28 is withdrawn to a sufficient degree to allow a ¾" thick slice to be cut. Adjusting knob 90 may be rotated past the storage position thereby releasing stop plate 28 from engagement with the housing 22 for convenient cleaning.

Figure 11:
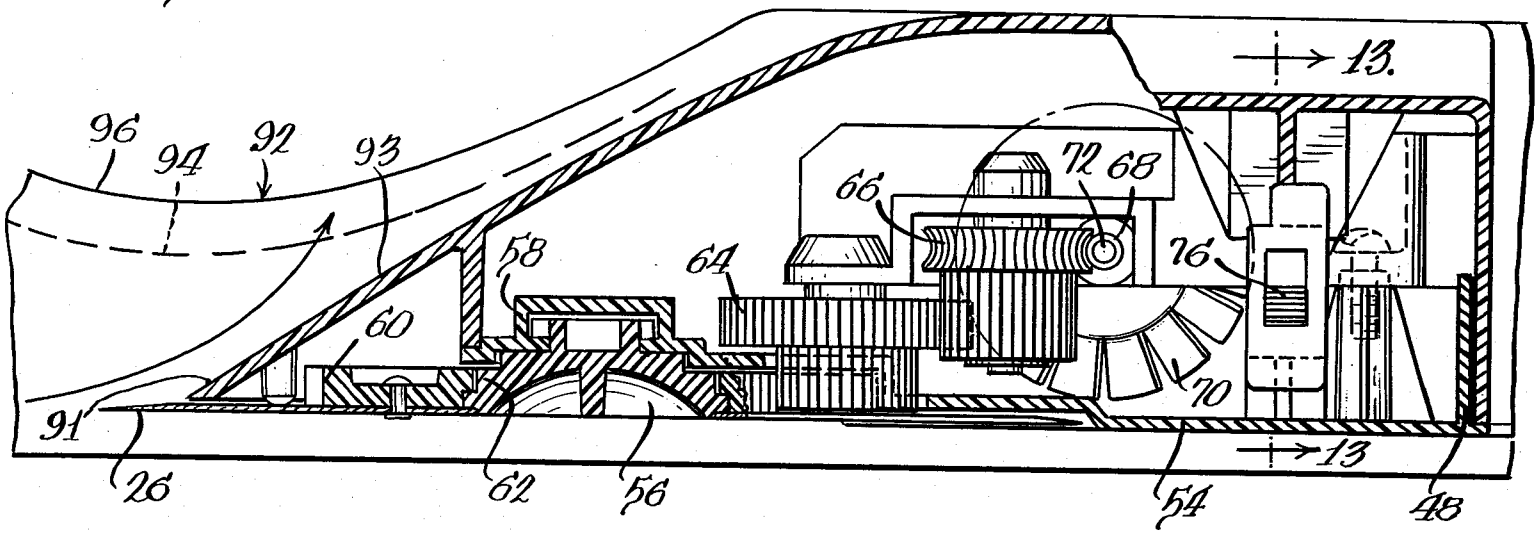
FIG. 11 is a top elevational view of a portion of the housing having portions broken away to illustrate more clearly the details of the invention.
Figure 12:
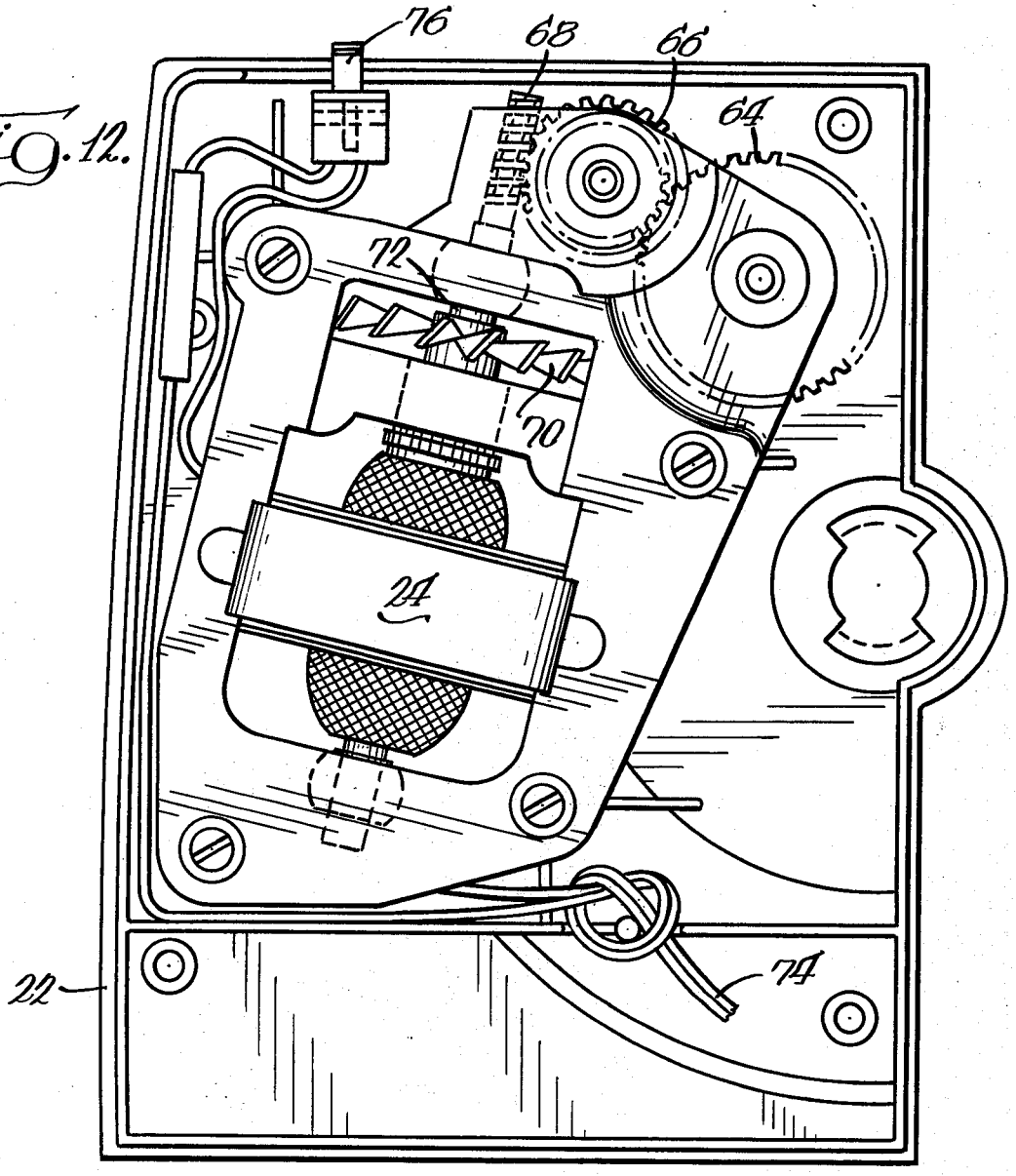
FIG. 12 is a view of the electric motor and assorted drive means.
Figure 13:
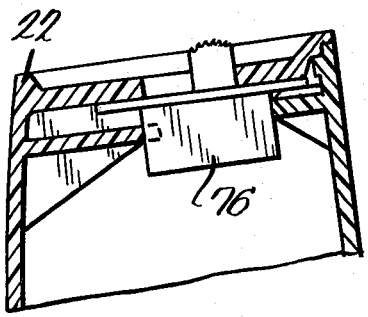
FIG. 13 is a sectional view of a portion of the housing showing details of the switch mount.

Slices of meat, cheese or the like are delivered from blade 28 to the rear portion of the slicer through an opening 91 in housing 22 and are deflected by an angled wall portion 93, shown in FIGS. 9 and 11. In order to prevent any of the juice from the sliced meat from being wasted and to prevent the sliced food from falling onto the supporting surface, a curved dish access member 92 is provided so that a dish can be received in proximity with slicing blade 28 to prevent wastage of meat juices. A substantially vertical arcuate wall 94 is formed integral with web members 44 and is supported thereby. It is apparent that vertical arcuate wall 94 can receive the edge of a dish. A curved drip ledge 96 is formed integral with the upper portion of vertical arcuate wall 94. Curved drip ledge 96 has a compound curve which follows the arc of vertical arcuate wall 94, as may best be seen in FIG. 4, while curving upward and away from blade 26, as may best be seen in FIG. 9. A stop plate aligning stub 98 extends upward from front wall 46 immediately forward of drip ledge 96 and engages stop plate 28 to prevent stop plate 28 from rotating with adjusting knob 90 when the latter is turned.

In order to support food to be sliced, table 30 is provided and in the operating position extends forward from housing 22 to which it is detachably secured. Table 30 is slidably fitted to a plurality of bracket members, respectively 100, 102, 104, and 106, which are formed integral with sides 45 and 45*a* of housing 22, as best shown in FIG. 4.

Bracket members 100, 102 and 104 extend from the lower portion of the side walls 45 and 45*a* of housing 22 and are angled with respect to the vertical in the same manner as housing 22. Table 30 inludes a pair of bracket engaging members, respectively 108 and 110, which fit over bracket members 100, 102, 104, and 106 so that bracket engaging member 108 has portions which straddle bracket members 100 and 102 while bracket engaging member 110 has portions which straddle bracket members 104 and 106. To assembly the table 30 to the housing 22, the bracket engaging members 108 and 110 are slid downwardly from above into engagement with the bracket members 100, 102, 104 and 106. Thus, table 30 is held snugly against housing 22. It should be noted that table 30 is primarily wedge-shaped and tapers toward bracket engaging members 108 and 110.

Immediately forward of bracket engaging members 108 is an elongated rubber shoe 112 and identical elongated shoe 114 is located forward bracket engaging member 110. Elongated rubber shoes 112 and 114 prevent table 30 and housing 22 from sliding upon a supporting surface during meat slicing operations thereby minimizing the risk that the operator may be injured by the slicing machine 20.

Figure 6:
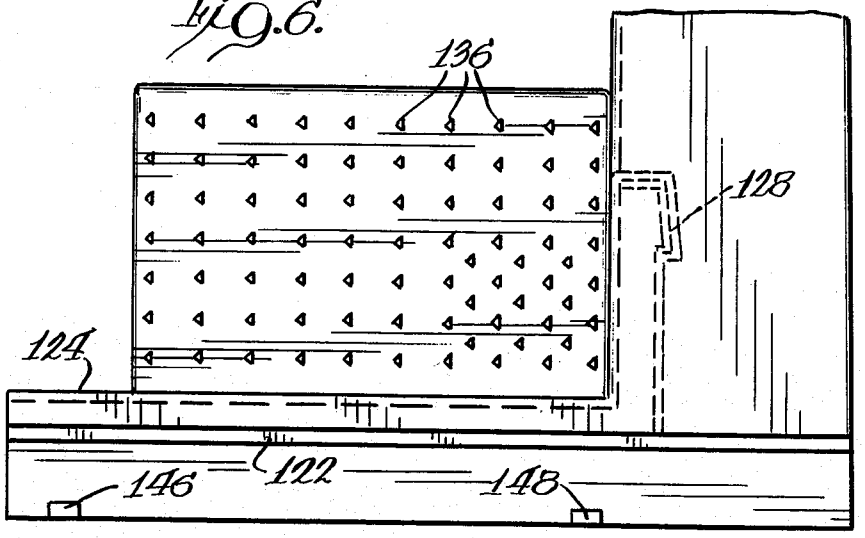
FIG. 6 is a view taken along line 6—6 of FIG. 5.
Figure 5:
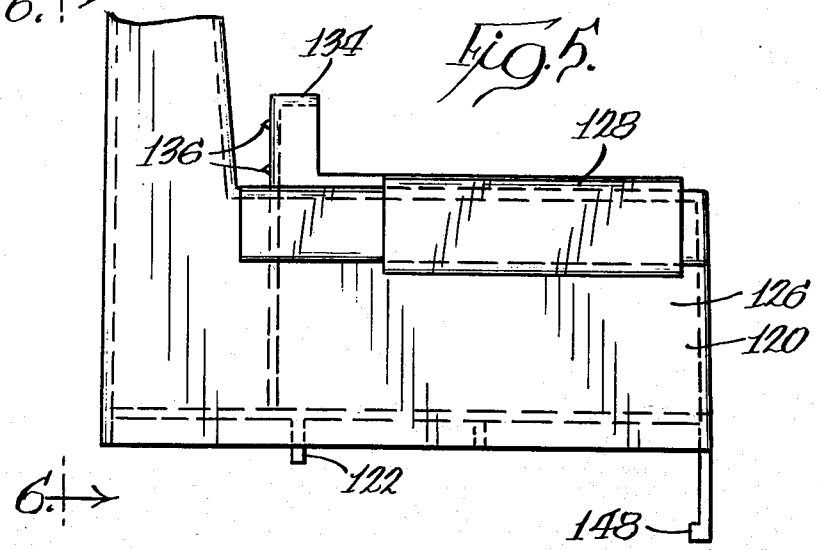
FIG. 5 is a side view of the pusher and slider assembly having a portion broken away.
Figure 7:
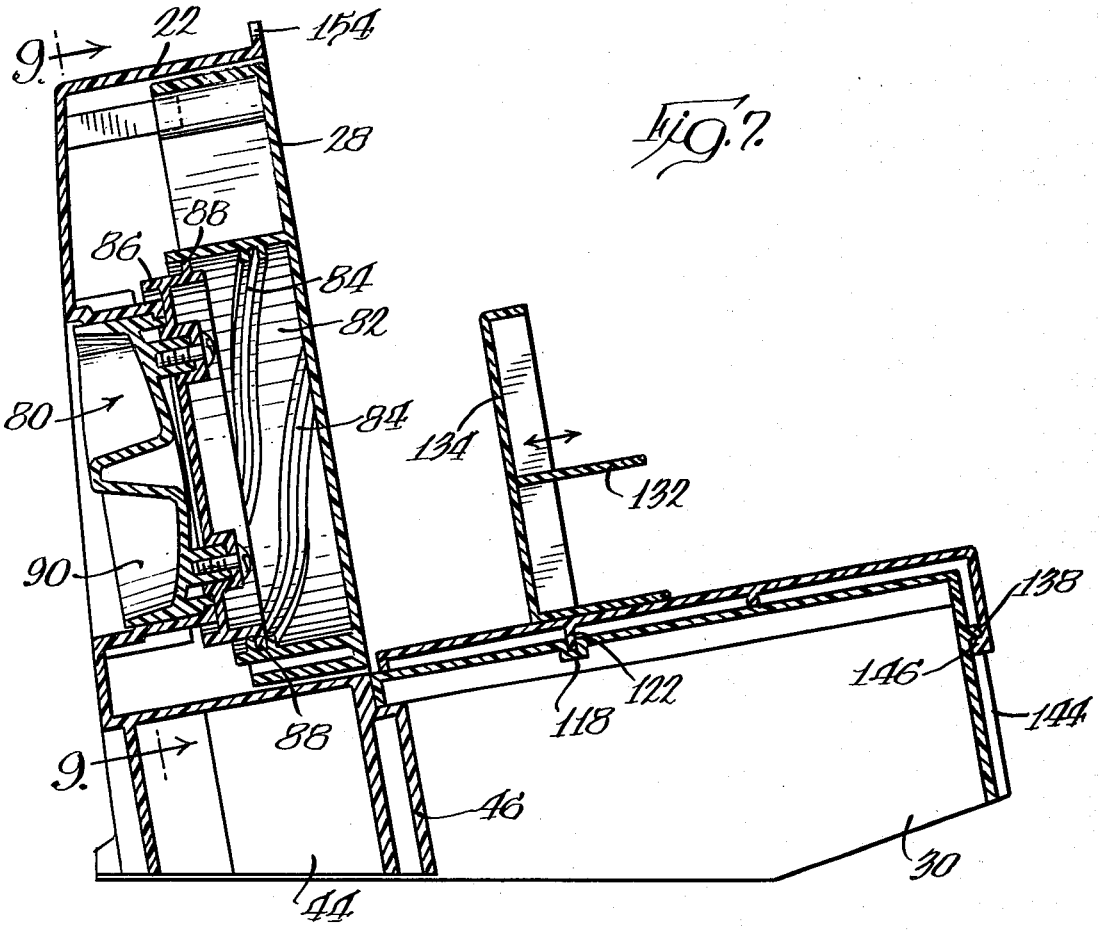
FIG. 7 is a sectional view of the present invention in operating configuration, the section being taken on line 7—7 of FIG. 1.

In order to support the foodstuffs adjacent the slicing blade 26, table 30 has a work surface 116 having a lateral groove 118 formed therein for receipt and guidance of a food platform 120, which has on its uppermost side a food receiving plate 124. Food platform 120 has a rib 122 which slidably fits in lateral groove 118. Rib 122 is formed integrally with the lower side of a food receiving plate 124 upon which the foodstuff to be sliced rests. A food pusher guide wall 126 is formed integral and perpendicular with food receiving plate 124 and slidably receives a mating dovetail section 128 of a food pusher 130. Food pusher 130 has a pair of supporting arcuate wall sections 132 which lend structural integrity to a food engaging blade 134 which has a plurality of spikes or fingers 136 which firmly hold foodstuff being sliced. The combination food platform and food pusher provides a guard for the hand of a user since the fingers of the right hand of the user wrap around the dovetail 128 behind plate 134 while the thumb rests on the opposite side of the dovetail thereby insuring that an intervening portion of the food platform or food pusher is always between the right hand of the operator and circular blade 26. Further guidance for the food platform 120 is provided by a longitudinal rib 138 formed integral with an end wall 140 of table 30 and having a pair of stop ribs, respectively 142 and 144 connected thereto, as shown in FIG. 1. A pair of ears 146 and 148 (See FIG. 6) of food platform 120 engage longitudinal rib 138 to hold food platform 120 in contact with work surface 116 of table 30, as shown in FIG. 7. The extent of travel of food platform 120 parallel to the plane in which blade 26 is positioned is limited by stop ribs 142 and 144 so that the dovetail section 128 of food pusher 130 does not travel completely past the center line of circular blade 26.

Figure 2:
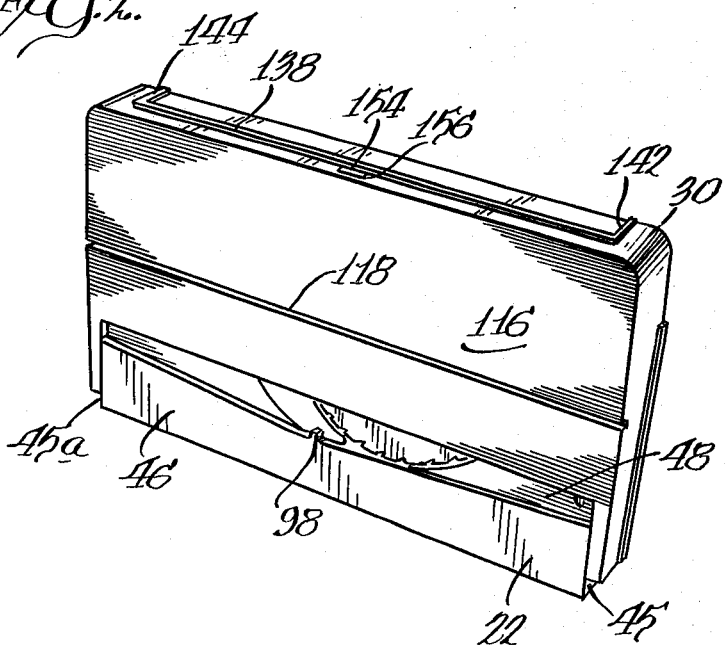
FIG. 2 is a perspective view of the present invention in storage configuration.
Figure 3:
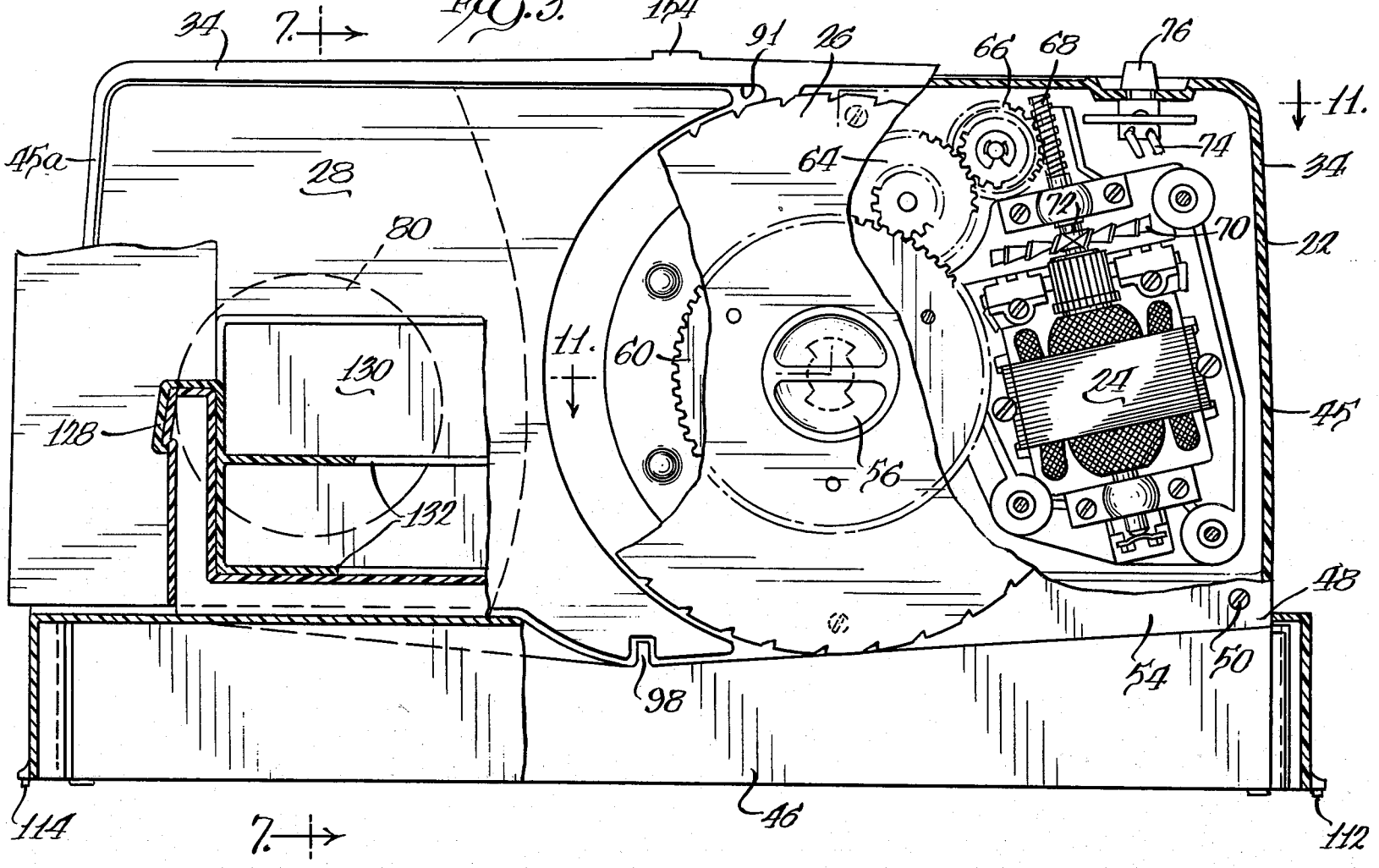
FIG. 3 is a somewhat enlarged sectional view taken substantially along line 3—3 of FIG. 1 having portions broken away to illustrate more clearly the present invention.

When food preparation has been completed and the slicer has been cleaned, it is desirable to store the slicer in as compact a volume as possible. In order to do so, table 30 can be slidably fitted over blade 26 and front housing wall 46, as shown in FIG. 2. When slicing machine 20 is in this storage configuration, a pair of bracket receiving notches, not shown, slidably engage brackets 100 and 104, respectively. A tab 154, extending from the upper portion of hosing 22, extends through a mating slot 156 formed in end wall 140 of table or cover 30 immediately adjacent the center portion of longitudinal lip 138, as shown in FIG. 2.

It is apparent that the slidable engaging combination table and cover 30 disclosed by the present invention do not rely upon hinges or other such members which are relatively expensive and are likely to reduce the structural integrity of a domestic slicing machine. The assembly of the table 30 to the housing 22 in the manner shown in FIG. 2 not only provides a compact storage arrangement for the table but also assures that the blade will be shielded against accidental engagement by the user. By nesting the housing 22 within the table 30 the most compact positioning is achieved. Furthermore, the slight rearward slope imparted to work surface 30 by the tapering side walls of the table aligns work surface 30 perpendicular with circular serrated blade 26 so that juices from meat being sliced are drawn away from the blade on curved drip ledge 96 and fall on to a plate or the like positioned thereunder. Furthermore, the slight rearward tilt of the entire slicing machine in its operative configuration causes the food to be sliced to be drawn toward the slicing blade so that the user does not have to supply all of the force required to urge the food into engagement with blade 26 thereby providing advantages which are apparent to the user.

While only a single embodiment of the present invention has been shown, it will be understood that various changes and modifications will occur to those skilled in the art and it is contemplated in the appended claims to cover all such changes and modifications as fall within the true spirit and scope of the present invention.

What is claimed as new and desired to be secured by Letters Patent of the United States is:

1. A slicing machine for use in the home for slicing foodstuffs, comprising, a housing containing an electric motor in driving connection with a flat circular blade, said blade being supported for rotation about its central axis and positioned in a recess in a housing wall, a stop plate mounted in said housing adjacent said blade and movable substantially perpendicualr to said blade to select a thickness of a slice of foodstuff being sliced, an opening formed in said housing adjacent said blade and said stop plate through which sliced food is discharged, the portion of said housing defining the lower edge of said opening being formed with a food dish receiving member which guides said sliced food through said opening onto a dish, said food dish receiving member including a first portion to position said dish and a second portion extending beyond said first portion to direct liquids from said food onto said dish, a table having a surface for supporting food to be moved toward and across said blade, said table being detachably mounted to the housing with said surface being above the lower edge of said blade and at a substantially right angle to said blade during operation, means detachably mounting said table in an alternative storage position partially enclosing said housing and being positioned with said surface substantially parallel to said blade.

2. A slicing machine as in claim 1 wherein said housing is of a generally flat rectangular shape with said blade lying in the plane of one wall of said housing and being provided with support means which positions said housing in a tilted position on a supporting surface, said table being tapered so that in said operational position the bottom surface of said table engages the support surface while its upper surface is perpendicular to said blade.

3. A slicing machine as in claim 2 wherein said table includes a pair of pliable elongated feet members which frictionally engage said supporting surface when said slicing machine is being operated to prevent said slicing machine from moving on the supporting surface.

4. A slicing machine as identified in claim 1 wherein said table and said housing are provided with cooperating portions which are detachably slidably engageable to support said housing and table in non-pivoting relationship in either the storage or operating position, a tab and tab slot which are in locking engagement in said storage position to secure said table to said housing.

5. A slicing machine for domestic use in slicing foodstuffs, comprising a housing containing an electric motor in driving connection with a circular blade, said blade being rotatable by said motor, a stop plate mounted in said housing movable substantially perpendicular to said blade to select a thickness of a slice of foodstuff being sliced, an opening formed in said housing adjacent said blade and said stop plate through which sliced food is discharged, the portion of said housing defining the lower edge of said opening being formed with an arcuate food dish receiving member which guides said sliced food through said opening onto a dish, said arcuate food dish receiving member including a first portion to position said dish and a second portion extending beyond said first portion to direct liquids from said food onto said dish.

6. The combination of claim 5 wherein said housing and said circular blade are tilted toward said dish and said second portion of said food dish receiving member is angled downwardly toward said dish whereby food juices dripping from said blade will be directed into said dish by said second portion.

7. A domestic slicer as in claim 5 including a table slidably fitted to the housing at a substantially right angle thereto during operation, said table covering said housing and being positioned in a substantially parallel position thereto for storage.

8. The combination of claim 7 wherein said table is formed with a flat rectangular food receiving surface having depending side walls on three sides thereof, said housing nesting within the side walls of said table when the housing and table are in their storage position.

9. The combination of claim 8 wherein said side walls comprise an end wall and two opposed walls, said opposed walls having outwardly extending brackets which straddle said housing in the operative position of said table, ribs on said housing which slide into assembled relation to cooperating portions of said brackets to restrain said housing and said table against pivotal and relative movement on a horizontal surface.

10. The combination of claim 9 wherein said brackets are formed to slide into locking engagement with said housing ribs in a storage position in which said housing is nested within said side wall of said table.

* * * * *